US010816192B2

(12) United States Patent
Sonwane et al.

(10) Patent No.: US 10,816,192 B2
(45) Date of Patent: Oct. 27, 2020

(54) INJECTOR MIXER FOR A COMPACT GASIFICATION REACTOR SYSTEM

(71) Applicant: GAS TECHNOLOGY INSTITUTE, Des Plaines, IL (US)

(72) Inventors: Chandrashekhar Sonwane, Los Angeles, CA (US); Kenneth M. Sprouse, Northridge, CA (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 324 days.

(21) Appl. No.: 15/919,789

(22) Filed: Mar. 13, 2018

(65) Prior Publication Data

US 2018/0202650 A1 Jul. 19, 2018

Related U.S. Application Data

(62) Division of application No. 14/116,858, filed as application No. PCT/US2011/038600 on May 31, 2011, now abandoned.

(51) Int. Cl.

| | |
|---|---|
| ***F23D 1/00*** | (2006.01) |
| ***C10J 3/50*** | (2006.01) |
| ***B01F 5/04*** | (2006.01) |

(52) U.S. Cl.

CPC ..... *F23D 1/005* (2013.01); *B01F 5/04* (2013.01); *C10J 3/506* (2013.01); *F23D 1/00* (2013.01); *C10J 2200/152* (2013.01)

(58) Field of Classification Search

CPC ..... B01F 5/04; C10J 3/506; C10J 2200/152; F23D 1/005; F23D 1/00

See application file for complete search history.

(56) References Cited

U.S. PATENT DOCUMENTS

2003/0196576 A1* 10/2003 Whittaker ..... C10J 3/506 110/260
2005/0281722 A1* 12/2005 Sprouse ..... C01B 3/38 423/220
2009/0038701 A1 2/2009 Delmotte
2010/0320296 A1* 12/2010 Tautz ..... F23D 14/76 239/591

(Continued)

FOREIGN PATENT DOCUMENTS

EP 1 717 295 A1 11/2006

OTHER PUBLICATIONS

Kang, S., Rho, B. (2000). Atomization characteristics of a double impinging F-0-0-F type injector with four streams for liquid rockets. KSME International Journal, vol. 14, No. 4. pp. 446-476. Jan. 1, 2000.

(Continued)

*Primary Examiner* — Anshu Bhatia

(74) *Attorney, Agent, or Firm* — Pauley Erickson & Swanson

(57) ABSTRACT

An injector mixer for a gasification reactor system that utilizes reactants includes an injector body that extends between a first face and a second face. The injector body includes a first passage that extends between the first face and the second face and has a first central axis. At least one second, impinging passage extends between the first face and second face and has an associated second central axis that has an angle with the first axis. The angle satisfies mixing efficiency Equation (I) disclosed herein.

17 Claims, 3 Drawing Sheets

(56) References Cited

U.S. PATENT DOCUMENTS

2014/0294695 A1 10/2014 Sonwane et al.

OTHER PUBLICATIONS

Kang, S., Ryu, K. (2001). An experimental study on turbulent characteristics of an impinging split-triplet injector. KSME International Journal, vol. 15, No. 1. pp. 117-124. Jan. 1, 2001.
Sprouse, K. Widman, F. and Darby, A. (2006). Conceptual design of an ultra-dense phase injector and feed system. Topical Report, Task 2. Injector and Feed System Development and Test. Apr. 2006.
Sprouse, K. Widman, F. and Darby, A. (2008). Dry coal feed system and multi-element injector test plan. Topical Report, Task 2. Injector and Feed System Development and Test. Aug. 30, 2006.

* cited by examiner

INJECTOR MIXER FOR A COMPACT GASIFICATION REACTOR SYSTEM

CROSS-REFERENCE TO RELATED APPLICATIONS

This application is a divisional of U.S. patent application Ser. No. 14/116,858, filed on 20 Jun. 2014, which is a U.S. National Phase (371) filing of PCT International Application No. PCT/US2011/38600, filed 31 May 2011. The co-pending parent and related applications are hereby incorporated by reference herein in its entirety and is made a part hereof, including but not limited to those portions which specifically appear hereinafter.

BACKGROUND

This disclosure relates to an injector mixer for a gasification reactor system that utilizes fuel material and oxidant reactants.

Fuel, such as pulverized coal, is known and used in the production of synthesis gas or syn-gas (e.g., a mixture of hydrogen and carbon monoxide) in gasification systems. In conventional gasification systems, the fuel is fed through a feed line into a reactor vessel. In the reactor vessel, the fuel mixes and reacts with oxidant to produce the synthesis gas as a reaction product.

A high velocity injector of a gasification system typically includes a plurality of passages through which the reactants are injected. In a pentad injector, the fuel is fed through a central passage and the oxidant is fed through four impinging passages such that the oxidant impinges upon the fuel stream on the reaction side of the injector.

For the high velocity pentad injector, the mixing efficiency of the reactants depends on the mass flow rate and densities of the reactants and the area of the passages of the injector, according to the Rupe Efficiency Elverum-Morey (EM) number where the impingement angle is 30°.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
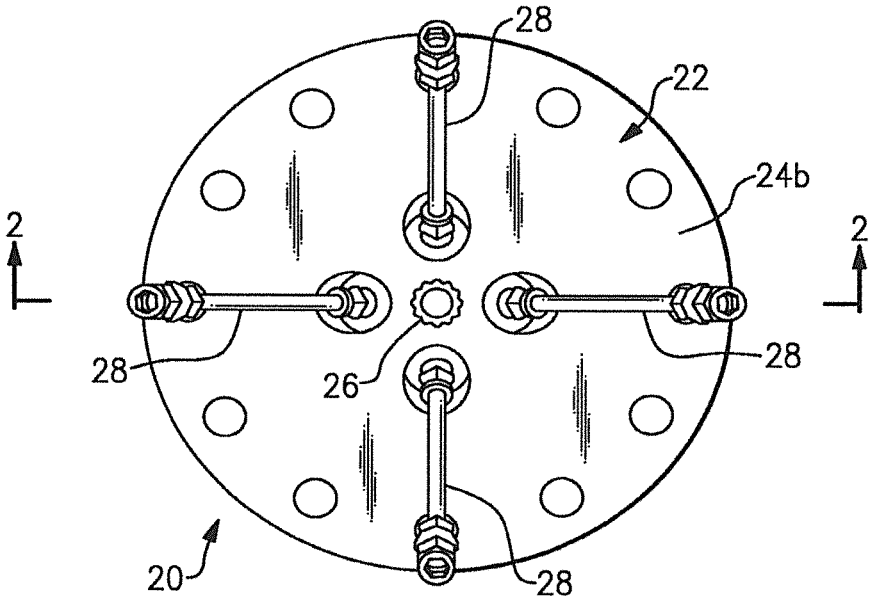
FIG. 1 shows an example injector mixer according to Equation (I) disclosed herein.
Figure 2:
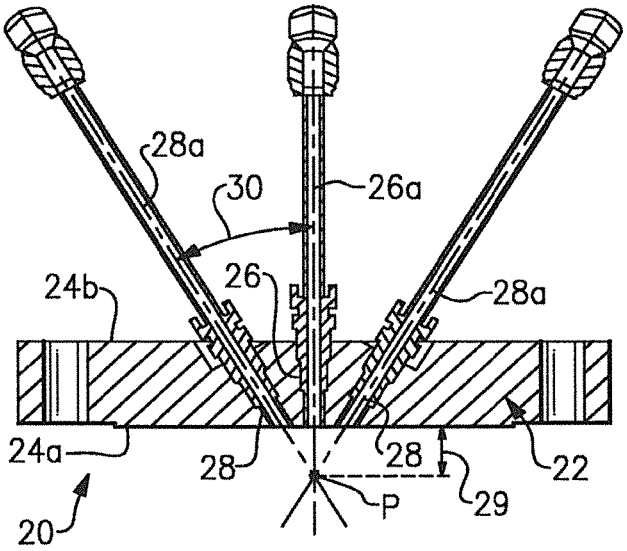
FIG. 2 shows a cross-sectional view of the injector mixer of FIG. 1.

FIG. 1 illustrates selected portions of an example injector mixer 20 for use in a gasification reactor system. FIG. 2 shows the injector mixer 20 according to the section line shown in FIG. 1. As will be described, the injector mixer 20 includes features for obtaining a targeted mixing efficiency between reactants in the gasification reactor system.

In one example, the fuel mixture is a dual-phase fuel mixture that includes a fuel material (e.g., pulverized coal) entrained in a carrier gas (e.g., nitrogen, carbon dioxide, etc.). In a further example, the carbonaceous particulate material is ultra-dense phase pulverized coal material that behaves as a Bingham plastic (at void fractions below 57%). In a further example, the pulverized coal material is dry (less than 18 wt % moisture) and nominally has 70 wt % of the particles that pass through a 200 mesh (74 micrometer) screen. As will be described, the injector mixer 20 includes features that allow a user to obtain a targeted mixing efficiency of the coal and steam/oxygen for different angles of impingement of the steam/oxygen upon the coal stream. It is to be understood that the examples disclosed herein are not limited to coal and may be used with other types of fuels, such as, but not limited to, petcoke and biomass.

In the illustrated example, the injector mixer 20 includes an injector body 22 that generally extends between a first face 24*a* and a second face 24*b*. For example, the injector body 22 is a circular plate and the first face 24*a* and the second face 24*b* lie in parallel planes to each other. In embodiments, the injector mixer 20 is one injector element of multi-element injector design for injecting reactants into a gasification reactor.

The injector body 22 includes a first passage 26 (e.g., a tube) that extends at least between the first face 24*a* and the second face 24*b* and along a first central axis 26*a*. The injector body 22 also includes a at least one second, impinging passage 28 (e.g., tube) that also extends between the first face 24*a* and the second face 24*b*. In the illustrated example, the injector body 22 includes four of the second passages 28 (i.e., a pentad injector), and the second passages 28 are circumferentially arranged around the first passage 26. Alternatively, the injector body 22 includes a single second passage 28 that extends entirely around the first passage (i.e., a conical injector), although the number and arrangement of the second passage or passage 28 are not limited to any particular design. In the illustrated example, the second passages 28 extend along respective second central axes 28*a* that have an angle θ, represented at 30, with the first axis 26*a*. For a conical injector that has a single second passage 28 in the form of a frustoconical ring around the first passage 26, the second passage has an associated axis, which is parallel to a surface of the frustoconical shape, that forms the angle .theta. (i.e., the half angle of the cone). Regardless of the specific design, the angle θ is not equal to 30° and satisfies mixing efficiency Equation (I):

$$2 \le 2\sin\theta\left(\frac{\dot{m}_{stox}}{\dot{m}_{fuel}}\right)^2 \left(\frac{\rho_{fuel}}{\rho_{stox}}\right)\left(\frac{A_{fuel}}{A_{stox}}\right)^{3.1} \le 7 \qquad \text{Eq. (I)}$$

where, $\dot{m}_{stox}$ is the mass flow rate of oxidant through the at least one second passage 28;

$\dot{m}_{fuel}$ is the mass flow rate of the fuel material through the first passage 26;

$\rho_{stox}$ is the density of the oxidant;

$\rho_{fuel}$ is the density of the fuel material;

$A_{fuel}$ is the cross-sectional area of the first passage 26; and $A_{stox}$ is the total cross-sectional area of the second passage or passages 28.

In one example, the fuel mixture is a dual-phase fuel mixture that includes a fuel material (e.g., coal) entrained in a carrier gas (e.g., nitrogen, carbon dioxide, etc.). In that regard, the fuel mixture includes solid particulate coal material and the carrier gas such that the density of the fuel stream is according to Equation (II):

$$\rho_{fuel}=\varepsilon\rho_{cg}+(1-\varepsilon)\rho_s \quad \text{Eq. (II)}$$

where ε is a predetermined void volume fraction of the coal, $\rho_s$ is the true solids density inherent in the coal and $\rho_{eg}$ is the inherent density in the carrier gas.

Figure 3:
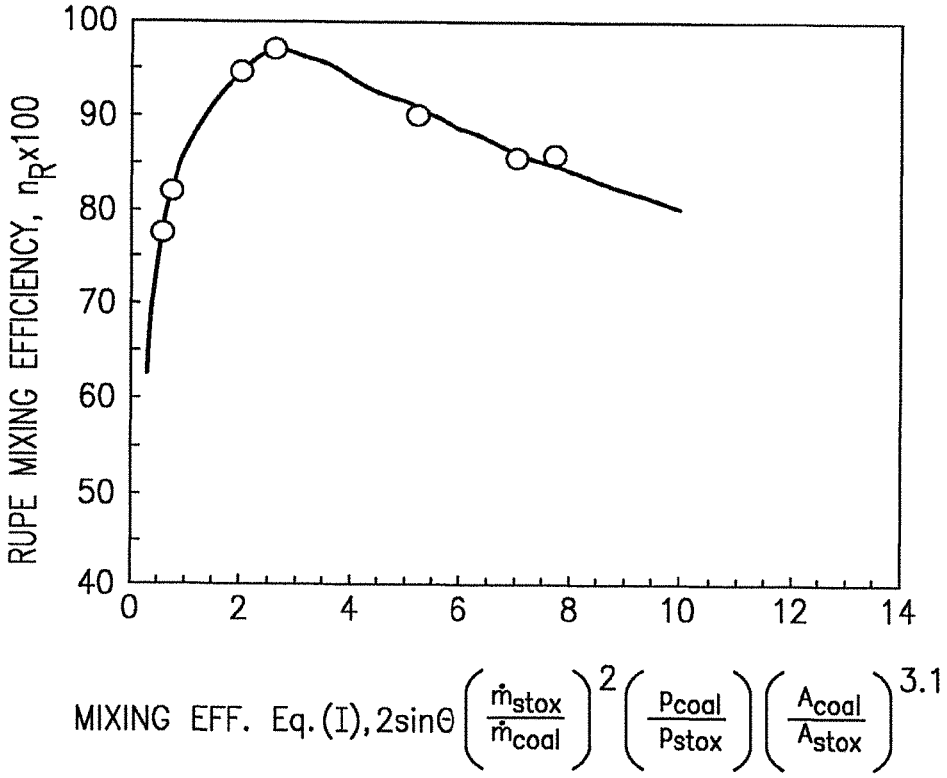
FIG. 3 shows a graph of Rupe Mixing Efficiency versus Equation (I) disclosed herein.

The angle θ that satisfies the mixing efficiency Equation (I) maintains a mixing efficiency between the coal and the steam/oxygen streams to be within a targeted mixing efficiency range from 2 to 7. As illustrated in FIG. 3, the mixing efficiency represented by Equation (I) corresponds to a Rupe Mixing Efficiency of the fuel material and oxidant. The Rupe Mixing Efficiency represents how well the reactants mix together and, thus, is an indicator of the efficiency of the gasification reaction. In this example, to achieve a high targeted Rupe mixing efficiency above 90%, the angle θ of the injector mixer 20 is selected such that Equation (I) is within the range from 2 to 7.

In a further example, the geometry of the first passage 26 and its central axis 26*a* and the second passage or passages 28 and the respective second central axes 28*a* establish a point (P) in space beyond the first face 24*a* at which the first central axis 26*a* and the second central axes 28*a* intersect (see FIG. 2). The point (P) is at a distance, represented at 29, of greater than 1.94 inches/4.93 centimeters from the first face 24*a*.

The injector mixer 20 with the feature that the satisfies Equation (I) also provides a designer of the injector mixer 20 and/or a gasification reactor system with another degree of freedom in designing the injector mixer 20 to obtain a high targeted mixing efficiency. In other words, a designer of the injector mixer 20 can select the angle θ with regard to given, known or calculated values of the other variables in Equation (I) to achieve a mixing efficiency within the disclosed range and thereby achieve high mixing efficiency. Alternatively, a designer can adjust one or both of $A_{fuel}$ and $A_{stox}$ in a preexisting injector, where it would be difficult to retroactively change the angle, to meet Equation (I). For example, $A_{fuel}$ and/or $A_{stox}$ is adjusted by installing a smaller diameter tube into either of the first passage 26 and/or second passage or passages 28. In another alternative, a designer can change the area ratio $A_{fuel}/A_{stox}$ in the design in combination with changing the angle θ and maintain a targeted mixing efficiency. In one example, the area ratio $A_{fuel}/A_{stox}$ is from 1 to 2 and the angle θ is not equal to 30°. In a further example, the area ratio $A_{fuel}/A_{stox}$ is 1.33 and the angle θ is less than 30°.

The term "establishing" or variations thereof refers to the selection of the angle θ and/or other variables such that the selected values satisfy Equation (I), to the designing of the angle θ and/or other variables such that the selected values satisfy Equation (I), to the making of the injector mixer 20 with the angle θ and other variables such that the selected values satisfy Equation (I), and/or to the implementation or use of the injector mixer 20 with the angle θ and other variables such that the selected values satisfy Equation (I).

Figure 4:
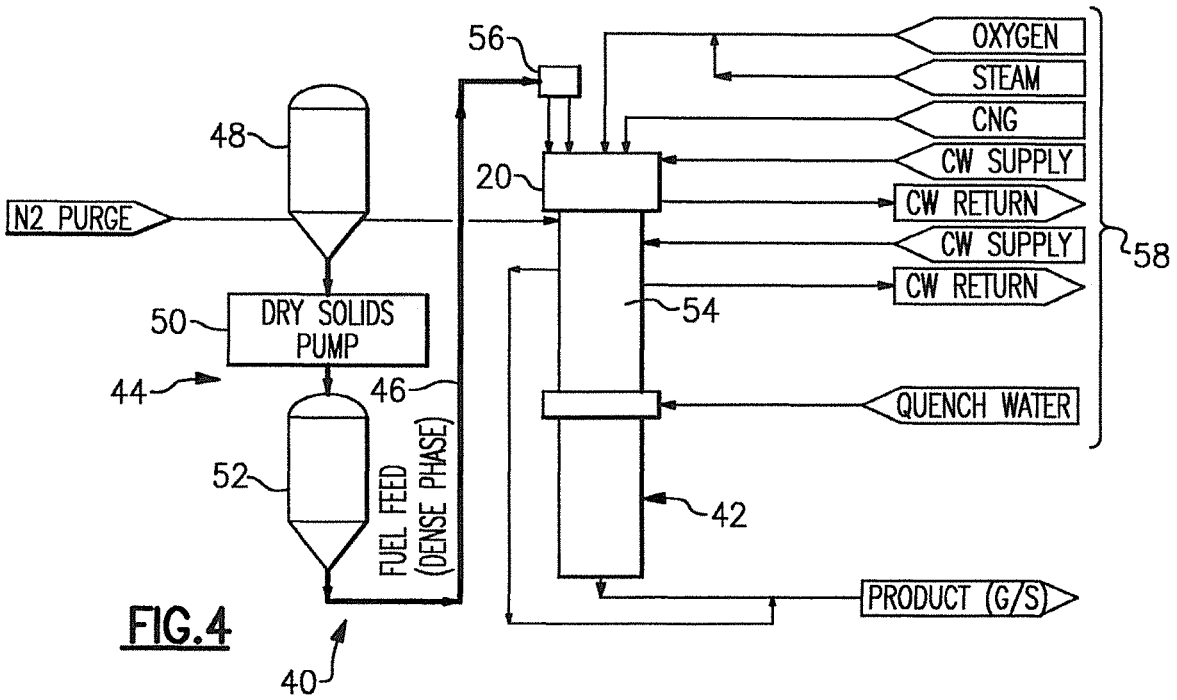
FIG. 4 shows an example gasification reactor system that incorporates an injector mixer according to Equation (I).

FIG. 4 illustrates an example gasification reactor system 40 that utilizes the injector mixer 20. It is to be understood that the gasification reactor system 40 includes a variety of components that are shown in the illustrated example but that this disclosure is not limited to particular arrangement shown. Other gasification reactor systems will also benefit from the examples disclosed herein.

In the illustrated example, the gasification reactor system 40 generally includes a reactor vessel 42, a fuel source 44, and a feed line 46 that fluidly connects the fuel source 44 and the reactor vessel 42.

The fuel source 44 includes a fuel lock hopper 48 that is generally operated at atmospheric pressure to provide the fuel mixture to a dry solids pump 50. As an example, the fuel lock hopper 48 includes a storage silo and may be sized according to the capacity of the gasification reactor system 40.

The dry solids pump 50 is an extrusion pump for moving the fuel mixture from the atmospheric pressure environment of the fuel lock hopper 48 to the high pressure environment (e.g., 1200 psia/8.3 MPa or greater) of the remaining portion of the gasification reactor system 40. Alternatively, the dry solids pump 50 is a belt pump or other suitable pump for moving the fuel mixture from the atmospheric pressure environment into the head of the high pressure environment of the remaining portion of the gasification reactor system 40.

The dry solids pump 50 feeds the fuel mixture to a fuel feed hopper 52. The fuel mixture is then fed from the fuel feed hopper 52 into the feed line 46. The carrier gas is introduced and regulated at the fuel feed hopper 52 in a known manner.

Although not shown, the fuel source 44 and feed line 46 also include sensors that are operable to provide feedback signals. For instance, the fuel feed hopper 52 and feed line 46 include one or more load cells, static pressure transducers, gas flow meters, delta pressure transducers and velocity meters for calculating velocity of the fuel material, gas pressure of the carrier gas, and void volume fraction of the fuel material in the fuel mixture. The viscosity of the carrier gas is a function of at least temperature and pressure and can be found in known reference values or determined in a known manner.

The feed line 46 connects to the reactor vessel 42. The reactor vessel 42 includes a gasifier chamber 54 for containing the reaction of the reactants. In general, the gasifier chamber 54 is a cylindrical chamber of known architecture for gasification reactions.

The reactor vessel 42 includes the injector mixer 20 at the top of the gasifier chamber 54. As shown in FIGS. 1 and 2, the injector mixer 20 is a pentad type injector, with the fuel mixture being fed through the first passage 26 and the oxidant being fed through the second passages 28. Alternatively, the fuel mixture is fed through the second passage or passages 28 and the oxidant is fed through the first passage 26.

In the illustrated example, the gasification reactor system 40 also includes a variety of support systems 58 for supplying the oxidant, cooling the injector mixer 20, cooling the gasifier chamber 54 and/or quenching the reaction products in a known manner.

As shown, a flow splitter 56 is installed in the feed line 46 between the fuel source 44 and the reactor vessel 42. The reactor vessel 42 and its injector mixer 20 are therefore in flow-receiving communication with the flow splitter 56.

In the illustrated example, the flow splitter 56 receives a single input flow from the feed line 46. The flow splitter 56 divides the flow from the feed line 46 into two streams, or more, that are discharged to the reactor vessel 42. For example, each of the divided streams is fed into a different one of multiple injector mixers 20 of the reactor vessel 42. In other examples, one or more of the divided streams are sent to another reactor vessel (not shown).

The flow splitter 56 uniformly divides flow of the fuel mixture. The injection of the uniformly divided streams into different injector mixers 20 in the gasifier chamber 54 facilitates the achievement of "plug flow" through the reactor vessel. The term "plug flow" refers to the continual axial (downward in the illustration) movement of the reactants and reactant products in the reactor vessel 42, rather than a flow that includes a portion of swirling back flow of the reactants and reactant products towards the injector mixers 20 upon injection into the gasifier chamber 54. The plug flow facilitates forward mixing of the reactants, higher reaction conversion and lower heat flux through the face of the injector mixers 20. In some examples, the plug flow results in an increase in cold gas efficiency for a given residency time and conversion rate of more than 99%. For example, the cold gas efficiency may be 80-85%. In further examples, the cold gas efficiency is 90%, 92% or 95%. In some examples, the plug flow may increase the efficiency of the system and thereby lower the system cost by about 50%. Additionally, the high-pressure, high density syn-gas that is produced requires smaller volumes in downstream units.

In the illustrated example, the ability to select the angle θ and other variables such that the selected values of the variables satisfy Equation (I) also facilitates the reduction of heat flux through the first face 24*a* of the injector mixer 20, which is on the reaction side in the gasifier chamber 54. The reduction in heat flux thereby also alleviates the burden on the cooling design of the injector mixer 20. Additionally, lowering the angle θ allows higher density of packaging of injector mixers 20 in a multi-element injector design and thus, a more compact reactor vessel 42. In some examples, the size of the reactor vessel 42 may be reduced by 90%, which facilitates retrofitting into existing gasifier systems.

Figure 5:
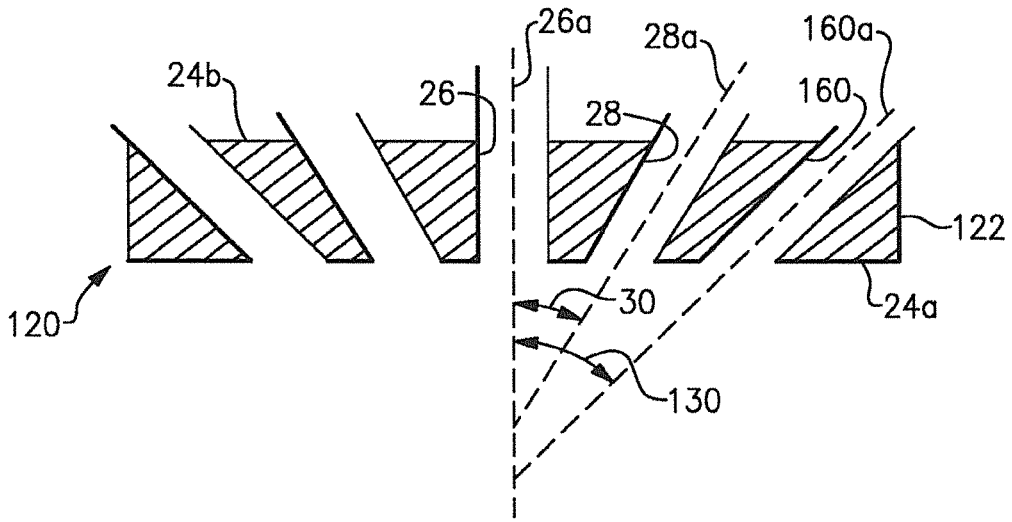
FIG. 5 shows another example injector mixer according to Equation (I) disclosed herein.

FIG. 5 illustrates another embodiment of an injector mixer 120, where like reference numerals designate like elements. In the illustrated example, in addition to the first passage 26 and second passage 28, the injector body 122 also includes at least one third, impinging passage 160 (e.g., a tube) that extends between the first face 24*a* and the second face 24*b* along central axis 160*a*. The central axis 160*a* has an angle $\theta_2$, represented at 130, with the first axis 26*a* that is different than an angle $\theta_1$, shown at 30, formed between the axis 28*a* and the axis 26*a*. The angles ($\theta_1$ and $\theta_2$) satisfy mixing efficiency Equation (I), as describe above.

The second passage or passages 28 and the third passage or passages 160 that form different angles with regard to the axis 26*a* allow the impingement angle to be changed during operation. That is, for a given set of operating parameters the second passage or passages 28 having angle $\theta_1$ are used to satisfy Equation (I). For the same or different operating parameters, the third passage or passages 160 having angle $\theta_2$ are used to satisfy Equation (I). The injector mixer 120 can be a pentad type, conic type or other type.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of maintaining mixing efficiency between reactants injected through an injector mixer comprising an injector body that extends between a first face and a second face, the injector body including a first passage extending between the first face and the second face and having a first central axis, and at least one second, impinging passage extending between the first face and the second face and having an associated second axis that has an angle θ with the first axis, the method comprising:

increasing a pressure of a fuel material reactant by moving the fuel material reactant through a dry solids pump;

establishing gasification parameter variables $\dot{m}_{stox}$, $\dot{m}_{fuel}$, $\rho_{stox}$, $\rho_{fuel}$, $A_{fuel}$, and $A_{stox}$ to satisfy mixing efficiency Equation (I):

$$2 \le 2\sin\theta\left(\frac{\dot{m}_{stox}}{\dot{m}_{fuel}}\right)^2\left(\frac{\rho_{fuel}}{\rho_{stox}}\right)\left(\frac{A_{fuel}}{A_{stox}}\right)^{3.1} \le 7 \qquad \text{Eq. (I)}$$

where, $\dot{m}_{stox}$ is the mass flow rate of oxidant reactant through the at least one second passage;

$\dot{m}_{fuel}$ is the mass flow rate of the fuel material reactant through the first passage;

$\rho_{stox}$ is the density of the oxidant reactant;

$\rho_{fuel}$ is the density of the fuel material reactant;

$A_{fuel}$ is the cross-sectional area of the first passage; and $A_{stox}$ is the total cross-sectional area of the at least one second passage; and wherein the angle θ is not equal to 30°;

feeding the fuel material reactant through the first passage and the oxidant reactant through the at least one second passage according to the established gasification parameter variables.

2. The method as recited in claim 1, wherein the at least one second passage of the injector mixer includes four second passages that are circumferentially arranged around the first passage.

3. The method as recited in claim 1, including establishing the angle to be less than 30°.

4. The method as recited in claim 1, including establishing a point in space beyond the first face of the injector mixer at which the first axis and the second axes intersect, and establishing the point to be at a distance of greater than 1.94 inches/4.93 centimeters from the first face.

5. The method as recited in claim 1, including establishing the area ratio $A_{fuel}/A_{stox}$ be from 1 to 2.

6. The method as recited in claim 1, including establishing a cold gas efficiency of at least 80%.

7. The method as recited in claim 1, including establishing a cold gas efficiency of at least 90%.

8. The method as recited in claim 1, including establishing a cold gas efficiency of at least 92%.

9. A method of establishing a targeted mixing efficiency between reactants injected through an injector mixer comprising an injector body that extends between a first face and a second face, the injector body including a first passage extending between the first face and the second face and having a first central axis, and at least one second, impinging passage extending between the first face and the second face and having an associated second axis that has an angle θ with the first axis, the method comprising:

increasing a pressure of a fuel material reactant by moving the fuel material reactant through a dry solids pump;

establishing gasification parameter variables $\dot{m}_{stox}$, $\dot{m}_{fuel}$, $\rho_{stox}$, $\rho_{fuel}$, $A_{fuel}$, and $A_{stox}$;

adjusting at least one of the gasification parameter variables to satisfy mixing efficiency Equation (I):

$$2 \leq 2\sin\theta\left(\frac{\dot{m}_{stox}}{\dot{m}_{fuel}}\right)^2\left(\frac{\rho_{fuel}}{\rho_{stox}}\right)\left(\frac{A_{fuel}}{A_{stox}}\right)^{3.1} \leq 7 \quad \text{Eq. (I)}$$

where, $\dot{m}_{stox}$ is the mass flow rate of oxidant reactant through the at least one second passage;

$\dot{m}_{fuel}$ is the mass flow rate of the fuel material reactant through the first passage;

$\rho_{stox}$ is the density of the oxidant reactant;

$\rho_{fuel}$ is the density of the fuel material reactant;

$A_{fuel}$ is the cross-sectional area of the first passage; and $A_{stox}$ is the total cross-sectional area of the at least one second passage; and wherein the angle θ is not equal to 30°; and feeding the fuel material reactant through the first passage and the oxidant reactant through the at least one second passage according to the adjusting of the at least one of the gasification parameter variables.

10. The method as recited in claim 9, including adjusting at least one of $A_{fuel}$ and $A_{stox}$ to satisfy mixing efficiency Equation (I).

11. A method for mixing reactants, the method comprising:

increasing a pressure of a fuel material reactant by moving the fuel material through a dry solids pump;

injecting reactants through an injector mixer comprising an injector body that extends between a first face and a second face, the injector body including a first passage for the fuel material reactant extending between the first face and the second face and having a first central axis, and at least one second, impinging passage for an oxidant reactant extending between the first face and the second face and having an associated second axis that has an angle θ with the first axis;

establishing gasification parameter variables $\dot{m}_{stox}$, $\dot{m}_{fuel}$, $\rho_{stox}$, $\rho_{fuel}$, $A_{fuel}$, and $A_{stox}$ for the injecting reactants to satisfy mixing efficiency Equation I:

$$2 \leq 2\sin\theta\left(\frac{\dot{m}_{stox}}{\dot{m}_{fuel}}\right)^2\left(\frac{\rho_{fuel}}{\rho_{stox}}\right)\left(\frac{A_{fuel}}{A_{stox}}\right)^{3.1} \leq 7$$

where, $\dot{m}_{stox}$ is a mass flow rate of the oxidant reactant through the at least one second passage;

$\dot{m}_{fuel}$ is a mass flow rate of a stream of the fuel material reactant through the first passage;

$\rho_{stox}$ is a density of the oxidant reactant;

$\rho_{fuel}$ is a density of the fuel material reactant;

$A_{fuel}$ is a cross-sectional area of the first passage; and $A_{stox}$ is a total cross-sectional area of the at least one second passage; and wherein the angle θ is not equal to 30°.

12. The method as recited in claim 11, wherein the at least one second passage of the injector mixer includes four second passages that are circumferentially arranged around the first passage.

13. The method as recited in claim 11, including establishing the angle to be less than 30°.

14. The method as recited in claim 11, including establishing a point in space beyond the first face of the injector mixer at which the first axis and the second axes intersect, and establishing the point to be at a distance of greater than 1.94 inches/4.93 centimeters from the first face.

15. The method as recited in claim 11, including establishing the area ratio $A_{fuel}/A_{stox}$ to be from 1 to 2.

16. The method as recited in claim 15, including establishing a cold gas efficiency of 95%.

17. The method as recited in claim 11, including establishing a cold gas efficiency of at least 80%.

* * * * *